US006148801A

United States Patent [19]

Wenzlawski

[11] Patent Number: 6,148,801

[45] Date of Patent: Nov. 21, 2000

[54] METHOD FOR CONTROLLING A FUEL QUANTITY TO BE FED TO AN INTERNAL COMBUSTION ENGINE AND ENGINE CONTROL DEVICE OPERATING ACCORDING TO THE METHOD

[75] Inventor: Klaus Wenzlawski, Nürnberg, Germany

[73] Assignee: Siemens Aktiengesellschaft, Munich, Germany

[21] Appl. No.: 08/931,214

[22] Filed: Sep. 15, 1997

[30] Foreign Application Priority Data

Sep. 13, 1996 [DE] Germany ..... 196 37 395

[51] Int. Cl.[7] ..... F02M 51/00

[52] U.S. Cl. ..... 123/492

[58] Field of Search ..... 123/492, 493, 123/357, 358

[56] References Cited

U.S. PATENT DOCUMENTS

| | | | |
|---|---|---|---|
| 4,223,654 | 9/1980 | Wessel et al. | 123/358 |
| 4,368,705 | 1/1983 | Stevenson et al. | 123/358 |
| 4,493,303 | 1/1985 | Thompson et al. | 123/357 |
| 4,709,335 | 11/1987 | Okamoto | 123/357 |
| 4,711,211 | 12/1987 | Oshizawa | 123/358 |
| 5,067,461 | 11/1991 | Joachim et al. | 123/358 |
| 5,261,378 | 11/1993 | Fenchel et al. | 123/357 |
| 5,315,977 | 5/1994 | Fosseen | 123/357 |

OTHER PUBLICATIONS

Japanese Patent Abstract No. 58150032 (Kiyotaka), dated Sep. 6, 1983.

Japanese Patent Abstract No. 60090950 (Giichi), dated May 22, 1985.

Horst Behnke et al.: "Die neuen Vierventil–Dieselmotoren von Mercedes–Benz Elektronische Dieselregelung und Einspritzung", MTZ Motortechnische Zeitschrift 54 (1993), pp. 490–503, the new Mercedes Benz four–valve diesel engines electronic diesel control and injection.

Dieter Seher: "Diesel–Einspritzung für weniger Emissionen bei Nutzfahrzeugmotoren", TZ MTZ Sonderheft Motor und Umwelt '92, pp. 31–33, Electronic Diesel Fuel Injection for the Improvement of Truck Emissions.

"Die neuen Vierventil–Dieselmotoren von Mercedes–Benz" (Horst Behnke et al.), MTZ, 54, 1993, pp. 490–503.

"Diesel–Einspritzung für weniger Emissionen bei Nutzfahrzeugmotoren", (Dieter Seher), MTZ, Special Issue Motor und Umwelt, 1992, pp. 31–33.

*Primary Examiner*—Erick Solis

*Attorney, Agent, or Firm*—Herbert L. Lerner; Laurence A. Greenberg; Werner H. Stemer

[57] ABSTRACT

A method for determining a fuel quantity to be fed to an internal combustion engine, includes initially determining a desired fuel quantity on the basis of a desired operational performance of the internal combustion engine. Moreover, a minimum air/fuel ratio is determined at which soot-free operation of the internal combustion engine is possible, and a maximum fuel quantity is determined on the basis of the minimum air/fuel ratio. The desired fuel quantity which is limited to the maximum fuel quantity is then determined as the fuel quantity to be fed to the internal combustion engine. It is advantageous in this case to determine the minimum air/fuel ratio in non-steady operation on the basis of a charging pressure or a difference between the charging pressure and the ambient pressure.

9 Claims, 1 Drawing Sheet

METHOD FOR CONTROLLING A FUEL QUANTITY TO BE FED TO AN INTERNAL COMBUSTION ENGINE AND ENGINE CONTROL DEVICE OPERATING ACCORDING TO THE METHOD

BACKGROUND OF THE INVENTION

Field of the Invention

The invention relates to a method for controlling a fuel quantity to be fed to an internal combustion engine, in which a desired fuel quantity is determined on the basis of a desired operational performance of the internal combustion engine, a minimum air/fuel ratio at which soot-free operation of the internal combustion engine is possible is determined, a limiting value is determined for the maximum fuel quantity on the basis of the minimum air/fuel ratio and a measured air mass, and the fuel quantity to be fed is limited to that limiting value.

To date, the fuel quantity to be fed to an internal combustion engine has been determined on the basis of a desired operational performance of the internal combustion engine. In that case, a soot limit of a Diesel engine has been fixed by a map which is determined in a steady state and which could further be overlaid with a torque limiting map.

However, it has been found that such a procedure does not always permit optimum operation of the internal combustion engine. Sooting of the internal combustion engine has been found, particularly during acceleration.

An article entitled "Diesel-Einspritzung fur weniger Emissionen bei Nutzfahrzeugmotoren" ["Diesel Injection for Fewer Emissions in Commercial Vehicle Engines"], by Seher, MTZ, in Sonderheft (Special Issue) Motor und Umwelt 1992, page 31, discloses a method for determining the fuel quantity to be fed to an internal combustion engine within the framework of electronic Diesel injection in which a permissible fuel quantity for smoke limitation is determined by using maps. The map is a function of the rotational speed, charging pressure, induction-air temperature and fuel temperature. The smoke limitation is carried out over the entire operating range of the engine, with a distinction being drawn between steady and non-steady operation.

An article entitled "Die neuen Vierventil-Dieselmotoren von Mercedes-Benz" ["The New Four-Valve Diesel Engines from Mercedes-Benz"], by Horst Behnke, in MTZ, 54, 1993, page 490, discloses an electronic Diesel control and injection system in which the full-load injection quantity for smokeless engine operation is ensured by a limitation on the minimum permissible air/fuel ratio. In a smoke map which is provided for this purpose, an injection mass optimized by engine test stand tests is recorded while taking account of the atmospheric pressure, induction-air temperature and fuel temperature. Steady-state full-load smoke and smoke emissions during non-steady operation are thereby largely suppressed.

SUMMARY OF THE INVENTION

It is accordingly an object of the invention to provide a method for controlling a fuel quantity to be fed to an internal combustion engine and an engine control device operating according to the method, which overcome the hereinaforementioned disadvantages of the heretofore-known methods and devices of this general type in such a way that the internal combustion engine is operated in a largely soot-free fashion in non-steady operation.

With the foregoing and other objects in view there is provided, in accordance with the invention, a method for determining a fuel quantity to be fed to an internal combustion engine, which comprises determining a desired fuel quantity on the basis of a desired operation performance of an internal combustion engine; determining a minimum air/fuel ratio at which soot-free operation of the internal combustion engine is possible; determining a minimum air/fuel ratio in non-steady operation on the basis of a difference between a charging pressure and an ambient pressure; determining a limiting value for a maximum fuel quantity on the basis of the minimum air/fuel ratio and a measured air mass; and limiting a fuel quantity to be fed, to the limiting value.

The increased sooting, for example during acceleration, can be ascribed to a lack of air. The formation of particulates is more intense during a load change due to the thermal conditions in the combustion chamber. For that reason, in the case of non-steady operation such as occurs, for example, during acceleration, the air/fuel ratio (ratio of air quantity to fuel quantity) must be increased in order to permit soot-free operation of the internal combustion engine. It is then possible, on the basis of the determined minimum air/fuel ratio at which soot-free operation of the internal combustion engine is ensured, to determine in relation to each currently ascertained air mass the limiting value of a maximum fuel quantity which permits soot-free operation under any circumstances. The desired fuel quantity to be fed to the internal combustion engine for a desired operational performance is then limited to that limiting value. If the desired fuel quantity is below the limiting value, the desired fuel quantity is fed unchanged to the internal combustion engine. If, by contrast, it is above the limiting value, the procedure according to the invention has the effect of appropriately reducing the desired fuel quantity to that limiting value.

Since the minimum air/fuel ratio and the air mass are determined continuously, it is thereby possible to ensure that there is always soot-free operation.

The minimum air/fuel ratio in non-steady operation of the internal combustion engine is advantageously determined on the basis of the charging pressure of the internal combustion engine or the difference between the charging pressure and the ambient pressure.

In accordance with another mode of the invention, by contrast, in steady operation of the internal combustion engine, the minimum air/fuel ratio is fixed at a predetermined value.

In accordance with a further mode of the invention, there is provided a method which comprises determining if a non-steady operating state is present on the basis of a gas pedal value difference.

In accordance with an added mode of the invention, there is provided a method which comprises determining a charging pressure difference between an actual charging pressure and a desired charging pressure, and determining that a non-steady operating state is present if the charging pressure difference is greater than zero or if a gas pedal value difference exceeds a predetermined threshold.

In accordance with an additional mode of the invention, there is provided a method which comprises determining a desired fuel quantity on the basis of a pedal value and a rotational speed, and fixing the desired fuel quantity by limiting a change in the desired fuel quantity.

In accordance with yet another mode of the invention, there is provided a method which comprises limiting the change in quantity on the basis of previous old values for fuel quantity and rotational speed as well as current new values of rotational speed and desired fuel quantity.

In accordance with yet a further mode of the invention, there is provided a method which comprises using a rotational speed, a temperature of the internal combustion engine and an ambient pressure to determine a further limiting value for a fuel quantity at which value a maximum torque of the internal combustion engine occurs, and limiting the fuel quantity to be fed, to the lower of the limiting values.

With the objects of the invention in view, there is also provided an engine control device operating according to the method.

Other features which are considered as characteristic for the invention are set forth in the appended claims.

Although the invention is illustrated and described herein as embodied in a method for controlling a fuel quantity to be fed to an internal combustion engine and an engine control device operating according to the method, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWINGS

The FIGURE of the drawing is a flow chart illustrating an exemplary embodiment of the invention.

DESCRIPTION OF THE PREFERRED EMBODIMENTS

Figure 1:
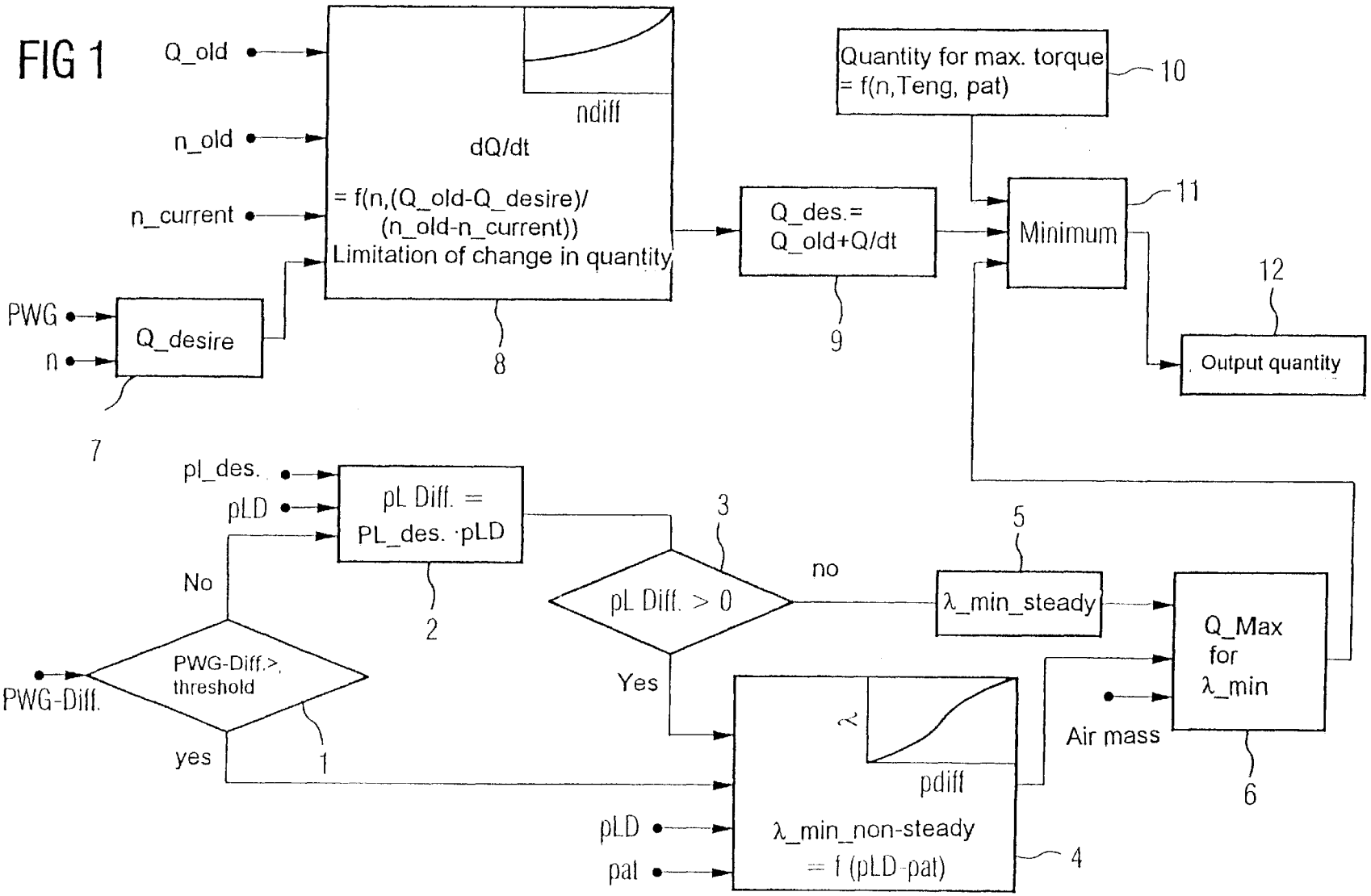

Referring now in detail to the single FIGURE of the drawing, there is seen an illustration of an exemplary embodiment of the method according to the invention.

Firstly, a current gas pedal value PWG of the vehicle having the internal combustion engine to be controlled is detected, and a gas pedal value difference PWG-Diff. is determined by comparison with a preceding gas pedal value. A check is performed in a step 1 as to whether or not the gas pedal value difference PWG-Diff. exceeds a predetermined threshold value. If this is not the case, a charging pressure difference pL Diff. between the desired value pL_des. for the charging pressure and the determined charging pressure pLD is determined in a step 2, and a check is performed in a step 3 as to whether or not the charging pressure difference pL Diff. is greater than zero.

If this is likewise not the case, a minimum air/fuel ratio λ_min_steady is determined in a step 5 through the use of a stationary value fixed for steady operation of the internal combustion engine.

If, by contrast, either the charging pressure difference is greater than zero in step 3 or the gas pedal value difference exceeds the predetermined threshold (non-steady operation) in step 1, a minimum air/fuel ratio is determined in a step 4 on the basis of the charging pressure. In this case, the ambient pressure pat which is determined is subtracted from the charging pressure pLD, with the minimum air/fuel ratio λ_min_non-steady for non-steady operation corresponding to a function of this difference.

In a step 6, a limiting value for the maximum fuel quantity Q_Max for soot-free operation is then determined from the minimum air/fuel ratio λ_min and the air mass that is currently determined.

Furthermore, a desired fuel quantity Q_desire is determined from an instantaneous gas pedal value PWG and a rotational speed n in a step 7.

However, since the desired fuel quantity can exceed the capability of the vehicle to be driven, in a step 8 a limitation of the change in quantity is carried out in which a maximum permissible change value for the fuel quantity is determined on the basis of previous old values for fuel mass Q_old and rotational speed n_old and current new values for rotational speed n_current and desired fuel quantity Q_desire.

The desired fuel quantity Q_des. is then determined in a step 9 by the addition of the old value Q_old and the change value dQ/dt of the fuel quantity.

Furthermore, a further limiting value for the fuel quantity, which corresponds to the maximum possible torque of the internal combustion engine, is determined in a step 10 on the basis of the rotational speed n, engine temperature Teng and ambient pressure pat.

Thereupon, the desired fuel quantity is limited in a step 11 to the lower of the two limiting values and output as an actually decisive desired fuel quantity in a step 12.

I claim:

1. A method for determining a fuel quantity to be fed to an internal combustion engine, which comprises:

determining a desired fuel quantity on the basis of a desired operation performance of an internal combustion engine;

determining a minimum air/fuel ratio at which soot-free operation of the internal combustion engine is possible;

determining a minimum air/fuel ratio in non-steady operation on the basis of a difference between a charging pressure and an ambient pressure;

determining a limiting value for a maximum fuel quantity on the basis of the minimum air/fuel ratio in non-steady operation and a measured air mass; and limiting a fuel quantity to be fed, to the limiting value.

2. The method according to claim 1, which comprises fixing the minimum air/fuel ratio in steady operation of the internal combustion engine at a predetermined value.

3. The method according to claim 1, which comprises determining if a non-steady operating state is present on the basis of a gas pedal value difference.

4. The method according to claim 3, which comprises determining a charging pressure difference between an actual charging pressure and a desired charging pressure, and determining that a non-steady operating state is present if the charging pressure difference is greater than zero.

5. The method according to claim 3, which comprises determining that a non-steady operating state is present if a gas pedal value difference exceeds a predetermined threshold.

6. The method according to claim 1, which comprises determining a desired fuel quantity on the basis of a pedal value and a rotational speed, and fixing the desired fuel quantity by limiting a change in the desired fuel quantity.

7. The method according to claim 5, which comprises limiting the change in quantity on the basis of previous old values for fuel quantity and rotational speed as well as current new values of rotational speed and desired fuel quantity.

8. The method according to claim 1, which comprises using a rotational speed, a temperature of the internal combustion engine and an ambient pressure to determine a further limiting value for a fuel quantity at which value a maximum torque of the internal combustion engine occurs, and limiting the fuel quantity to be fed, to the lower of the limiting values.

9. An engine control device for determining a fuel quantity to be fed to an internal combustion engine, comprising:

a device for determining a desired fuel quantity on the basis of a desired operation performance of an internal combustion engine;

a device for determining a minimum air/fuel ratio at which soot-free operation of the internal combustion engine is possible;

a device for determining a minimum air/fuel ratio in non-steady operation on the basis of a difference between a charging pressure and an ambient pressure;

a device for determining a limiting value for a maximum fuel quantity on the basis of the minimum air/fuel ratio in non-steady operation and a measured air mass; and a device for limiting a fuel quantity to be fed, to the limiting value.

* * * * *